US005858935A

United States Patent [19]

Watts et al.

[11] Patent Number: 5,858,935

[45] Date of Patent: Jan. 12, 1999

[54] AUTOMATIC TRANSMISSION FLUIDS WITH IMPROVED TRANSMISSION PERFORMANCE

[75] Inventors: Raymond F. Watts, Long Valley; Manoj Tandon, Princeton, both of N.J.

[73] Assignee: Exxon Chemical Patents Inc, Linden, N.J.

[21] Appl. No.: 766,190

[22] Filed: Dec. 12, 1996

Related U.S. Application Data

[63] Continuation-in-part of Ser. No. 552,967, Nov. 3, 1995, abandoned.

[51] Int. Cl.[6] ..... C10M 111/04

[52] U.S. Cl. ..... 508/591; 252/73; 585/10; 585/12; 585/13

[58] Field of Search ..... 508/591

[56] References Cited

U.S. PATENT DOCUMENTS

| | | | |
|---|---|---|---|
| 3,637,503 | 1/1972 | Giannetti et al. | 585/10 |
| 4,031,020 | 6/1977 | Sugiura et al. | 508/473 |
| 5,387,346 | 2/1995 | Hartley et al. | 588/188 |

FOREIGN PATENT DOCUMENTS

| | | |
|---|---|---|
| 0008453 | 9/1983 | European Pat. Off. . |
| 0240813 | 10/1987 | European Pat. Off. . |
| 0361180 | 4/1990 | European Pat. Off. . |
| 0604408 | 6/1994 | European Pat. Off. . |
| 1906674 | 10/1969 | Germany . |
| 2524118 | 12/1975 | Germany . |
| 1057368 | 2/1967 | United Kingdom . |
| 1124016 | 8/1968 | United Kingdom . |
| 1264981 | 2/1972 | United Kingdom . |
| WO89/12665 | 12/1989 | WIPO . |

OTHER PUBLICATIONS

"Formulating Broadly Csross–graded Lubricants with a high VI Polyalphaolefin", *Practical Lubrication and Maintenance*, pp. 10–11.

*Primary Examiner*—Ellen M. McAvoy

[57] ABSTRACT

Power transmitting fluids, especially automatic transmission fluids, possess improved properties such as antiwear, durability, antioxidation, and shift-time performance by incorporation of high viscosity polyalphaolefins.

21 Claims, 4 Drawing Sheets

AUTOMATIC TRANSMISSION FLUIDS WITH IMPROVED TRANSMISSION PERFORMANCE

This application is a continuation in part of application Ser. No. 08/552,967, filed Nov. 3, 1995, now abandoned.

BACKGROUND OF THE INVENTION

The present invention relates to power transmitting fluids, particularly automatic transmission fluids, of enhanced performance capabilities.

Automobile builders continually strive to produce more durable vehicles. Overall vehicle durability is a function of the durability of each of the components in the vehicle, e.g., the engine, transmission, etc. In order to improve overall vehicle durability, the durability of every major component in the vehicle must be improved. To improve the durability of the automatic transmission, automatic transmission fluids (ATF's) of improved performance must be produced. Relative performance of an automatic transmission fluid can be determined by evaluating the consistency of transmission shifts with increasing time or mileage, the extent to which the transmission has worn, and the extent to which the ATF has oxidized and sheared (lost viscosity). What we have now found is a method of simultaneously improving all of these ATF performance characteristics.

Although many 'bench' tests have been devised to evaluate ATF performance, e.g., SAE #2 friction test machines and Vickers vane pump tests, the best assessment of transmission durability is gained from running an actual transmission. Running a transmission in an extremely severe operating regime, under highly controlled conditions, is quite difficult. However, General Motors has devised such a test. It is described in the General Motors DEXRON®-III specification as the 4L60 Cycling Test (ATF Specification GM-6297M, April 1993, Appendix F). In this test a full automobile driveline (engine and transmission) is loaded by means of an energy absorption dynamometer. The dynamometer is programmed to simulate the inertia of a fully laden vehicle. With the transmission sump temperature held at 135° C., the engine is accelerated from idle to 3400 rpm under full throttle conditions. Each acceleration from idle to 3400 rpm is termed a 'cycle'. A standard test consists of 20,000 cycles. This test correlates very well with severe field service. Using this test to evaluate overall transmission durability and fluid degradation, what we have now found, is that ATF's that contain a minor amount of a high viscosity polyalphaolefin as part of the base oil mixture provide unexpected good transmission durability.

SUMMARY OF THE INVENTION

This invention describes a power transmission fluid, adaptable as an automatic transmission fluid, that provides significantly improved power transmission device durability and service life. This invention is comprised of:

(1) a major amount of a lubricating oil comprising:
- (a) no less than 50 weight percent of a natural lubricating oil having a kinematic viscosity from 1 to 10 $mm^2/s$ when measured at 100° C.
- (b) up to 49 weight percent of a synthetic lubricating oil having a viscosity from 1 to 10 $mm^2/s$ when measured at 100° C.
- (c) from 1 to 25 weight percent of a high viscosity polyalphaolefin having a kinematic viscosity from 40 to 500 $mm^2/s$ when measured at 100° C.

When used as an automatic transmission flud there will also be included a minor amount of an automatic transmission fluid additive package.

DETAILED DESCRIPTION OF THE INVENTION

Figure 1:
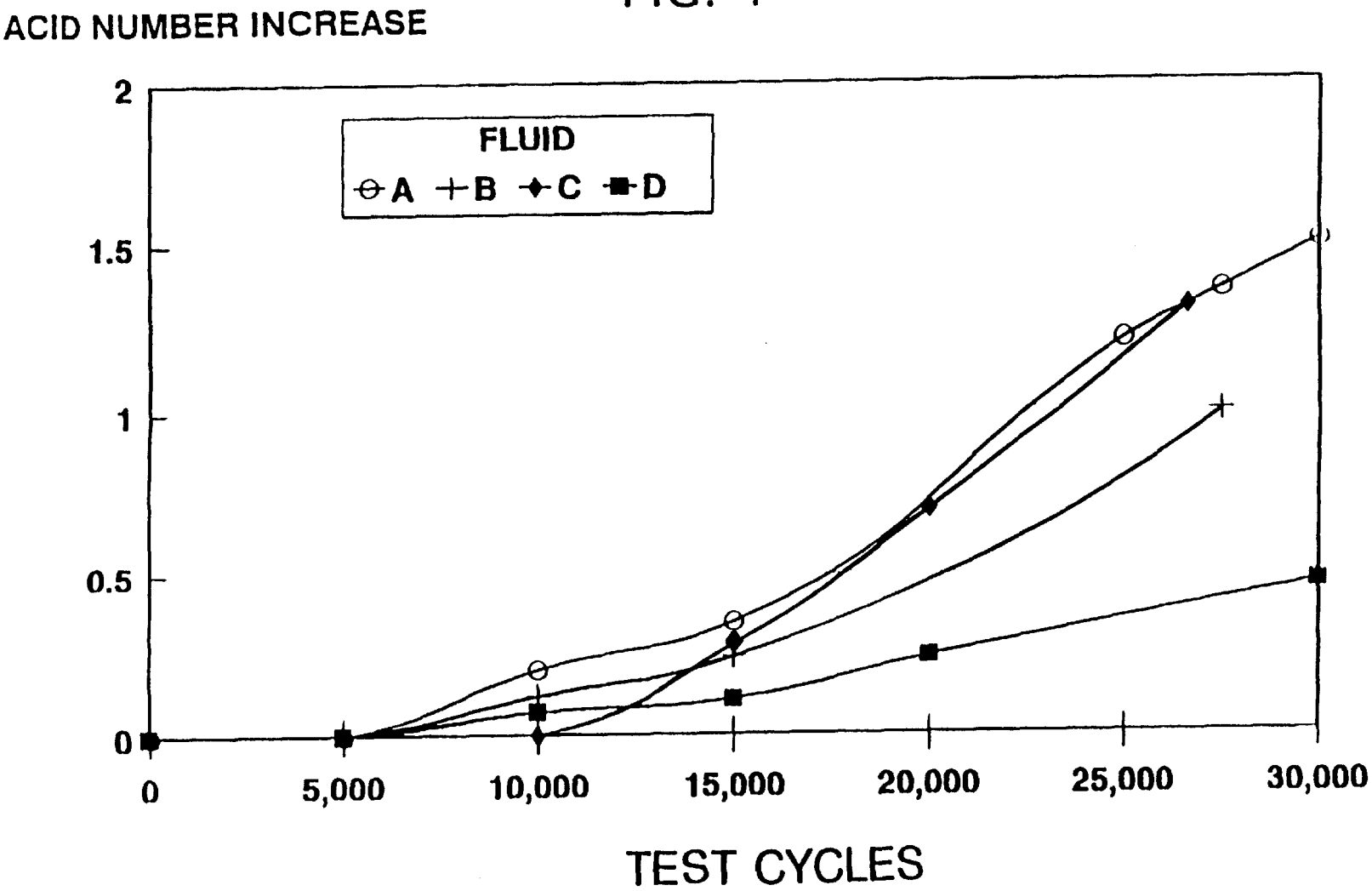
FIG. 1 depicts fluid acid number increase as a function of test cycles according to the General Motors DEXRON®-III, 4L60 Cycling Test.

What has now been found is that incorporation of minor amounts of high viscosity polyalphaolefins in automatic transmission fluids, produces automatic transmission fluids of exceptional service life. These transmission fluids also provide unexpectedly good wear protection and shift durability to the transmissions they are used in.

While the invention is demonstrated for a particular power transmitting fluid, i.e., an ATF, it is contemplated that the benefits of this invention are equally applicable to other power transmitting fluids. Examples of other types of power transmitting fluids included within the scope of this invention are manual transmission oils, gear oils, hydraulic fluids, heavy duty hydraulic fluids, industrial oils, power steering fluids, pump oils, tractor fluids, universal tractor fluids, and the like. These power transmitting fluids can be formulated with a variety of performance additives and a variety of base oils.

Lubricating Oils

Lubricating oils useful in this invention are derived from natural lubricating oils, synthetic lubricating oils, and their mixtures. In general, both the natural and synthetic lubricating oil will each have a kinematic viscosity ranging from about 1 to about 10 $mm^2/s$ (cSt) at 100° C.

Natural Lubricating Oils

Natural lubricating oils include animal oils, vegetable oils (e.g., castor oil and lard oil), petroleum oils, mineral oils, and oils derived from coal or shale.

The natural lubricating oils will be present in this invention in amounts no less than 50, preferably from 50 to 90, most preferably from 60 to 85 weight percent in the finished fluid.

The preferred natural lubricating oil is mineral oil. Suitable mineral oils include all common mineral oil basestocks. This includes oils that are naphthenic or paraffinic in chemical structure. Oils that are refined by conventional methodology using acid, alkali, and clay or other agents such as aluminum chloride, or they may be extracted oils produced, for example, by solvent extraction with solvents such as phenol, sulfur dioxide, furfural, dichlordiethyl ether, etc. They may be hydrotreated or hydrofined, dewaxed by chilling or catalytic dewaxing processes, or hydrocracked. The mineral oil may be produced from natural crude sources or be composed of isomerized wax materials or residues of other refining processes.

The mineral oils may be derived from refined, rerefined oils, or mixtures thereof. Unrefined oils are obtained directly from a natural source or synthetic source (e.g., coal, shale, or tar sands bitumen) without further purification or treatment. Examples of unrefined oils include a shale oil obtained directly from a retorting operation, a petroleum oil obtained directly from distillation, or an ester oil obtained directly from an esterification process, each of which is then used without further treatment. Refined oils are similar to the unrefined oils except that refined oils have been treated in one or more purification steps to improve one or more properties. Suitable purification techniques include distillation, hydrotreating, dewaxing, solvent extraction, acid or base extraction, filtration, and percolation, all of which are known to those skilled in the art. Rerefined oils are obtained by treating used oils in processes similar to those used to obtain the refined oils. These rerefined oils are also known as reclaimed or reprocessed oils and are often additionally processed by techniques for removal of spent additives and oil breakdown products.

Typically the mineral oils will have kinematic viscosities of from 2.0 to 8.0 $mm^2/s$ (cSt) at 100° C. The preferred mineral oils have kinematic viscosities of from 2 to 6 $mm^2/s$ (cSt), and most preferred are those mineral oils with viscosities of 3 to 5 $mm^2/s$ (cSt) at 100° C.

Synthetic Lubricating Oils

The synthetic lubricating oils of the present invention will comprise up to 49, preferably from 3 to 49, more preferably from 5 to 40, most preferably from 10 to 25 weight percent of the finished fluid. Synthetic lubricating oils improve the low temperature characteristics of the formulations.

Synthetic lubricating oils include hydrocarbon oils and halo-substituted hydrocarbon oils such as oligomerized, polymerized, and interpolymerized olefins [e.g., polybutylenes, polypropylenes, propylene, isobutylene copolymers, chlorinated polylactenes, poly(1-hexenes), poly (1-octenes), poly(1-decenes) etc., and mixtures thereof]; alkylbenzenes [e.g., dodecyl-benzenes, tetradecylbenzenes, dinonyl-benzenes, di(2-ethylhexyl)benzene, etc.]; polyphenyls [e.g., biphenyls, terphenyls, alkylated polyphenyls, etc.]; and alkylated diphenyl ethers, alkylated diphenyl sulfides, as well as their derivatives, analogs, and homologs thereof, and the like. Preferred oils from this group of synthetic oils are oligomers of polyalphaolefins, particularly oligomers of 1-octene and 1-decene.

Synthetic lubricating oils also include alkylene oxide polymers, interpolymers, copolymers, and derivatives thereof where the terminal hydroxyl groups have been modified by esterification, etherification, etc. This class of synthetic oils is exemplified by: polyoxyalkylene polymers prepared by polymerization of ethylene oxide or propylene oxide; the alkyl and aryl ethers of these polyoxyalkylene polymers (e.g., methyl-polyisopropylene glycol ether having an average molecular weight of 1000, diphenyl ether of polypropylene glycol having a molecular weight of 1000–1500); and mono- and poly-carboxylic esters thereof (e.g., the acetic acid esters, mixed $C_3$–$C_8$ fatty acid esters, and $C_{12}$ oxo acid diester of tetraethylene glycol).

Another suitable class of synthetic lubricating oils comprises diesters which are the esters of dicarboxylic acids (e.g., phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoethers, propylene glycol, etc.). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebasic acid with two moles of tetraethylene glycol and two moles of 2-ethylhexanoic acid, and the like. A preferred type of oil from this class of synthetic oils are adipates of $C_4$ to $C_{12}$ alcohols.

Esters useful as synthetic lubricating oils also include those made from $C_5$ to $C_{12}$ monocarboxylic acids with polyols and/or polyol ethers. Examples of polyols are neopentyl glycol, trimethylolpropane pentaerythritol, and the like. Common polyol ethers are dipentaerythritol, tripentaerythritol, and the like. Specific examples of polyol esters derived from either linear or branched chain acids, or mixtures thereof, would include: trimethylolpropane trisebacate; pentaerythritol tetrapentanoate; trimethylolpropanetrioctanoate;neopentylglycoldidecanoate;pentaerythritol tetraoctanoate, and dipenterythritol hexapentanoate.

The preferred synthetic oils are polyalphaolefins, diesters, and polyol esters as previously described having kinematic viscosities from 2 to 8, most preferably from 3 to 5 $mm^2/s$ when measured at 100° C.

High Viscosity Polyalphaolefins

Polyalphaolefins (PAO's) are oligomers of terminally unsaturated alkenes. The polyalphaolefins of the current invention are characterized by their viscosities. For purposes of this invention, the high viscosity polyalphaolefins are defined as possessing kinematic viscosities at 100° C. of from about 40 to about 500 $mm^2/s$ (cSt). Production of high viscosity polyalphaolefins is well known in the art and is described for example in U.S Pat. No. 4,041,098.

The preferred polyalphaolefins are made from 1-octene, 1-decene, or mixtures thereof. They can be saturated or unsaturated. The preferred PAO's have kinematic viscosities at 100° C. from about 50 to about 150, most preferably 100 $mm^2/s$ (cSt). These materials can be obtained commercially for instance as SYNTON® PAO-40 and SYNTON® PAO-100 from Uniroyal Chemical Co.

The compositions of this invention will contain a minor amount of the high viscosity polyalphaolefin. Typically, amounts range from 1 to 25, preferably from 2 to 20, most preferably 5 to 15 weight percent in the finished fluid.

Automatic Transmission Fluid Additive Packages

Automatic transmission fluid additive packages are well known in the art. They confer to a base oil composition the required characteristics to make that base oil function acceptably in an automatic transmission. These characteristics would include, but not be limited to, oxidation stability, wear protection, friction control, dispersancy, low temperature fluidity, seal swell, and foam suppression. A typical automatic transmission fluid additive package would have a composition such as shown below:

| COMPONENT | MASS % |
|---|---|
| Ashless Dispersant | 56.250 |
| Anti-wear Agent | 6.250 |
| Anti-oxidant | 6.250 |
| Corrosion Inhibitor | 0.625 |
| Friction Modifier | 3.125 |

-continued

| COMPONENT | MASS % |
|---|---|
| Seal Swell Agent | 6.250 |
| Pour Depressant | 3.125 |
| Anti-foamant | 0.625 |
| Diluent Oil | 17.500 |

The additive package above is referred to a detergent inhibitor (DI) package. DI packages typically treat from 3 to 10 mass percent in the ATF.

The ATF additive package may also contain a viscosity modifier. In that case the additive is referred to as a combined package or DI/VI. An example of a DI/VI package is shown below:

| COMPONENT | MASS % |
|---|---|
| DI Package (as above) | 67.000 |
| Viscosity Modifier | 33.000 |

A DI/VI package typically treats at from 5 to 20 mass percent in the ATF.

Examples of commercially available ATF performance additive packages are: PARANOX® 440, PARANOX® 442, PARANOX® 445, and PARATORQ® 4520 sold by Exxon Chemical Company; Hitec® E-400, Hitec® E-403, Hitec® E-410, and Hitec® E-420 sold by Ethyl Additive Company; and Lubrizol® 6268, Lubrizol® 7900, and Lubrizol® 9600 sold by the Lubrizol Corporation.

EXAMPLES

The following examples are given as specific illustrations of the claimed invention. It should be understood, however, that the invention is not limited to the specific details set forth in the examples. All parts and percentages are by weight unless otherwise specified.

Four automatic transmission fluids, Fluids A, B, C, and D, were prepared for evaluation and their compositions are shown in Table 1. The base additive package used in these fluids contained conventional amounts of succinimide dispersant, antioxidants, an antiwear agent, a corrosion inhibitor, antifoamant, friction modifiers, and a diluent oil.

TABLE 1

TEST FLUIDS

| FLUIDS: | A | B | C | D |
|---|---|---|---|---|
| BASE ADDITIVE PACKAGE | 8.00 | 8.00 | 8.00 | 8.00 |
| ADDITIONAL CORROSION INHIBITOR | 0.00 | 0.20 | 0.05 | 0.00 |
| Petro-Canada 80 HT BASE OIL (KV = 3.5 mm2/s @ 100° C.) | 92.00 | 81.80 | 81.95 | 82.00 |
| POLYMETHACRYLATE VI | 0.00 | 0.00 | 4.00 | 0.00 |
| PAO-4 (KV = 4 mm2/s @ 100° C.) | 0.00 | 10.00 | 0.00 | 0.00 |
| PAO-100 (KV = 100 mm2/s @ 100° C.) | 0.00 | 0.00 | 0.00 | 10.00 |
| KINEMATIC VISCOSITY @ 100° C. | 4.1 | 4.1 | 5.7 | 5.8 |

Fluids A–D were evaluated using a slight modification to the previously described GM DEXRON-III 4L60 Cycling Test. The modification to the test was that instead of stopping the test at 20,000 cycles, the test was allowed to continue for 30,000 cycles or until the transmission failed to operate, whichever occurred first. Only two of the fluids completed the 30,000 cycle test, Fluids A and D. Neither Fluid B nor Fluid C completed the 30,000 cycles. Fluid B was stopped at 26,632 cycles due to elongated 1–2 shift times, and Fluid C was stopped at 27,564 cycles due to pump failure.

FIGS. 1 through 4 show the performance of the four fluids in the transmission cycling test. FIG. 1 shows the increase in acid number of the fluid as a function of cycles. Fluids A and C have acid number increases in the range of 1.5 units. Fluid B with the extra inhibitor and PAO-4, has a slightly lower acid number increase, approximately 1 unit. However, Fluid D, the fluid with 10% PAO-100, has by far the lowest acid number increase, i.e., less than 0.5 units.

Figure 2:
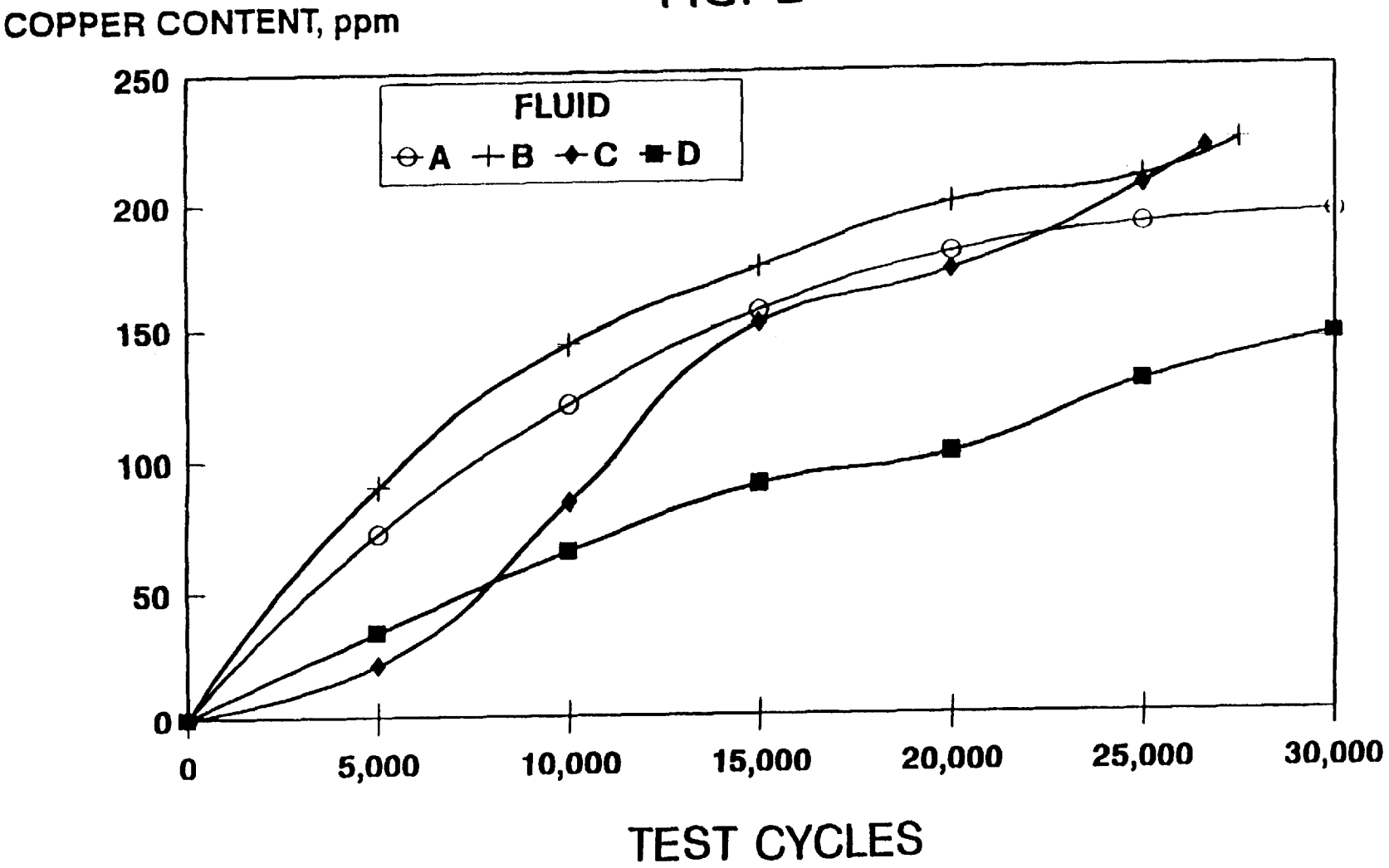
FIG. 2 depicts fluid copper content as a function of test cycles according to the General Motors DEXRON®-III, 4L60 Cycling Test.

FIG. 2 shows the increase in copper content in the fluids versus test cycles. Fluid D has the lowest increase in copper during the test. Fluids B and C contain extra added corrosion inhibitors and still end up with more copper than Fluid D. Copper level can be equated with overall wear protection in the transmission.

Figure 3:
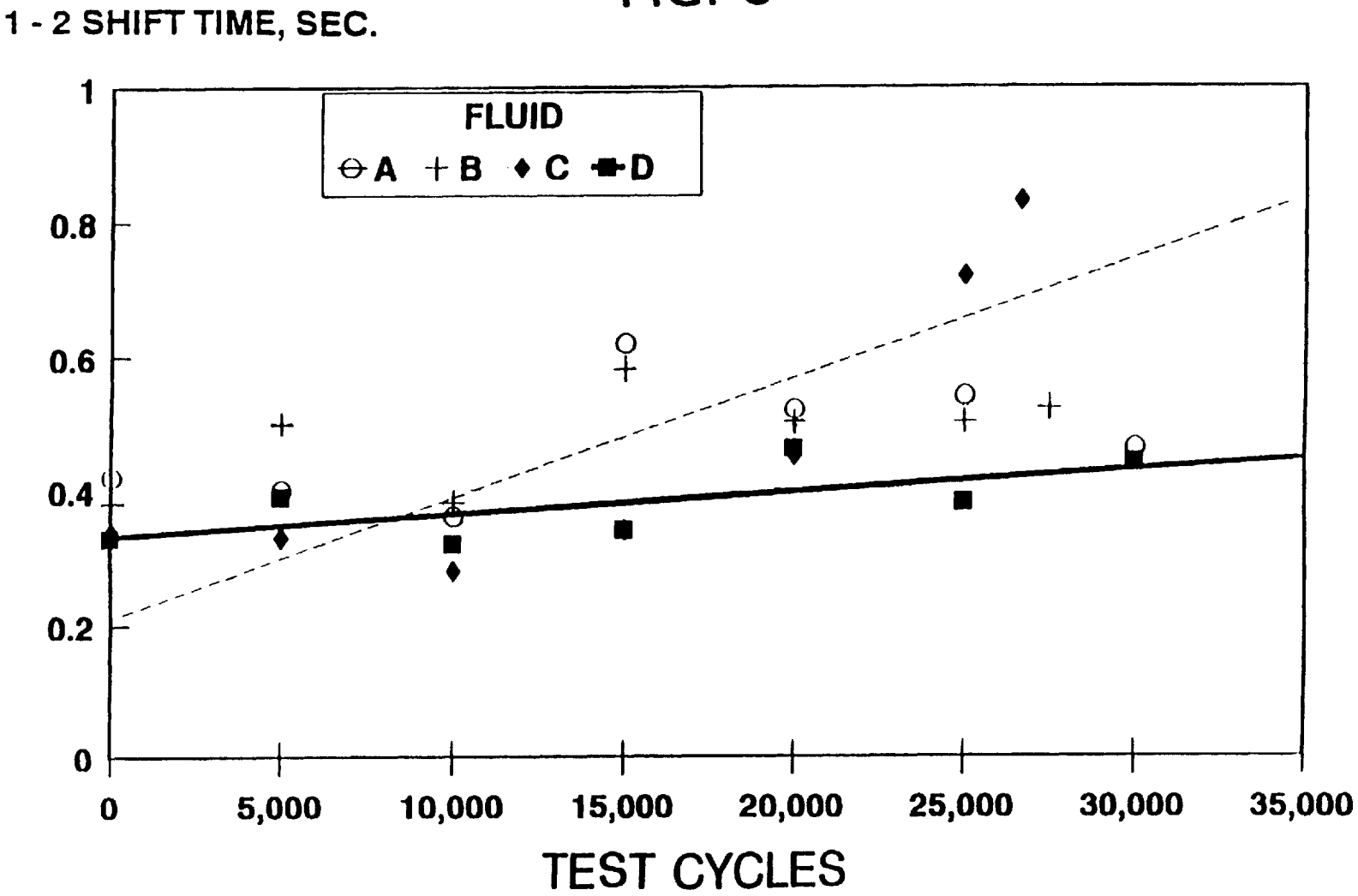
FIG. 3 depicts fluid 1–2 shift time as a function of test cycles according to the General Motors DEXRON®-III, 4L60 Cycling Test.

FIG. 3 shows 1–2 shift time as a function of cycles. The lines in FIG. 3 are shown as trend lines since the data has some variability. Fluids B and C actually fail the test due to elongating shift times so their trend lines rise with increasing cycles. Fluids A and D complete the test so their trend lines are of lower slope. Closer examination of the data indicates that the 1–2 shift times for Fluid D are the lowest and most consistent and thus represents the most desirable performance. The 1–2 shift times for Fluid A are quite variable.

Figure 4:
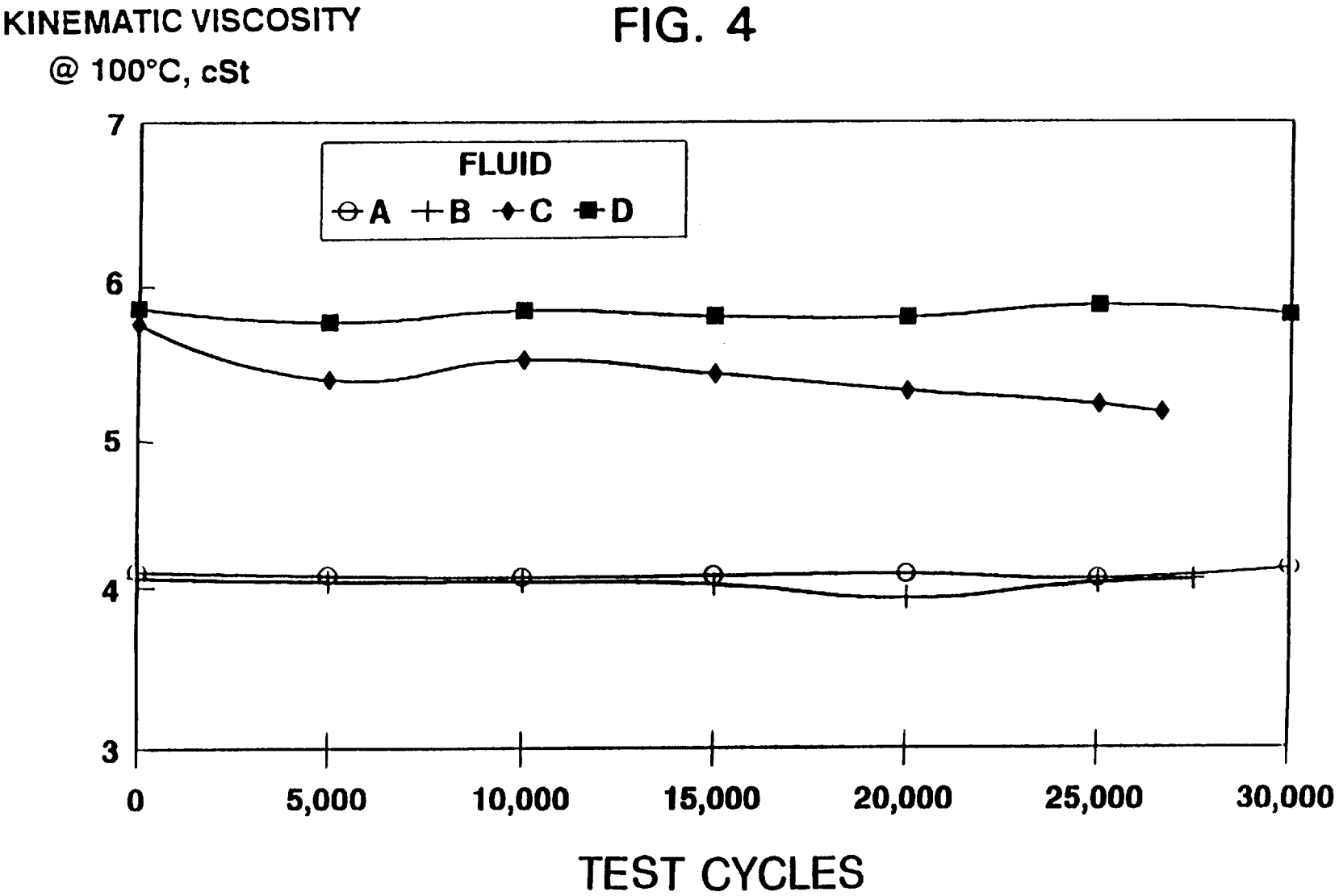
FIG. 4 depicts fluid kinematic viscosity as a function of test cycles according to the General Motors DEXRON®-III, 4L60 Cycling Test.

FIG. 4 shows viscosity as a function of test cycles. Fluid D containing the PAO-100 is the best performing fluid in all parameters, and it does have the highest viscosity. However, Fluid C, having the same fresh oil viscosity as Fluid D does not perform as well. Therefore, viscosity cannot be the sole reason Fluid D performs so well. Also, Fluid C loses over 10% of its viscosity during the test, while the viscosity of Fluid D remains relatively unchanged.

All of this data taken together shows that Fluid D is by far the best performing fluid in this very severe test. It out performs straight mineral oil, a viscosity modified mineral oil with added corrosion inhibitor, and a mineral oil with 10% PAO-4 plus added corrosion inhibitors.

The principles, preferred embodiments, and modes of operation of the present invention have been described in the foregoing specification. The invention which is intended to be protected herein, however, is not to be construed as limited to the particular forms disclosed, since these are to be regarded as illustrative rather than instructive. Variations and changes may be made by those skilled in the art without departing from the spirit of the invention.

What is claimed is:

1. An automobile transmission of improved performance, in combination with a fluid comprising:

(a) no less than 50 weight percent of a natural lubricating oil having a kinematic viscosity from 1 to 10 $mm^2/s$ when measured at 100° C.;

(b) up to 49 weight percent of a synthetic lubricating oil having a kinematic viscosity from 1 to 10 $mm^2/s$ when measured at 100° C., and (c) from 1 to 25 weight percent of a high viscosity polyalphaolefin having a kinematic viscosity from 40 to 500 $mm^2/s$ when measured at 100° C.

2. The automobile transmission combination of claim 1 wherein the amount of synthetic lubricating oil is 3 to 49 weight percent.

3. The automobile transmission combination of claim 2 which additionally contains a minor amount of an automatic transmission fluid additive package.

4. The automobile transmission combination of claim 3 wherein the amount of synthetic lubricating oil is 10 to 25 weight percent.

5. A method of reducing copper wear in an automatic transmission which comprises filling the automatic transmission with a fluid comprising:

(a) no less than 50 weight percent of a natural lubricating oil having a kinematic viscosity from 1 to 10 $mm^2/s$ when measured at 100° C.;

(b) up to 49 weight percent of a synthetic lubricating oil having a kinematic viscosity from 1 to 10 $mm^2/s$ when measured at 100° C., and (c) from 1 to 25 weight percent of a high viscosity polyalphaolefin having a kinematic viscosity from 40 to 500 $mm^2/s$ when measured at 100° C.

6. The method of claim 5, wherein the fluid contains 5 to 40 weight percent of synthetic lubricating oil.

7. The method of claim 4, wherein the fluid contains 10 to 25 weight percent of synthetic lubricating oil.

8. The method of claim 7, wherein the polyalphaolefin has a kinematic viscosity from 50 to about 150 $mm^2/s$ at 100° C.

9. The method of claim 8, wherein the polyalphaolefin is present in the amount of 2 to 20 weight percent.

10. The method of claim 9, wherein the polyalphaolefin is present in the amount of 5 to 15 weight percent.

11. The method of claim 10, wherein the natural lubricating oil is present in the amount of 60 to 85 weight percent.

12. A power transmitting fluid of improved performance, comprising:

(a) no less than 50 weight percent of a natural lubricating oil having a kinematic viscosity from 1 to 10 $mm^2/s$ when measured at 100° C.;

(b) from 3 to 49 weight percent of a synthetic lubricating oil having a kinematic viscosity from 1 to 10 $mm^2/s$ when measured at 100° C.; and (c) from 1 to 25 weight percent of a high viscosity polyalphaolefin having a kinematic viscosity from 40 to 500 $mm^2/s$ when measured at 100° C.

13. The fluid of claim 12 which additionally contains a minor amount of an automatic transmission fluid additive package.

14. The fluid of claim 13, wherein the amount of synthetic lubricating oil is 10 to 25 weight percent.

15. A method of reducing copper wear in an automatic transmission which comprises filling the automatic transmission with the fluid of claim 13.

16. The method of claim 15, wherein the fluid contains 5 to 40 weight percent of synthetic lubricating oil.

17. The method of claim 16, wherein the fluid contains 10 to 25 weight percent of synthetic lubricating oil.

18. The method of claim 17, wherein the polyalphaolefin has a kinematic viscosity from 50 to about 150 $mm^2/s$ at 100° C.

19. The method of claim 18, wherein the polyalphaolefin is present in the amount of 2 to 20 weight percent.

20. The method of claim 19, wherein the polyalphaolefin is present in the amount of 5 to 15 weight percent.

21. The method of claim 20, wherein the natural lubricating oil is present in the amount of 60 to 85 weight percent.

* * * * *